United States Patent [19]

Rawlins

[11] Patent Number: 4,686,728

[45] Date of Patent: Aug. 18, 1987

[54] AUTOMATIC SWIMMING POOL CLEANER

[76] Inventor: David J. Rawlins, 106 Hedy La., Davis, Calif. 95616

[21] Appl. No.: 707,245

[22] Filed: Mar. 1, 1985

[51] Int. Cl.[4] ..... E04H 3/20

[52] U.S. Cl. ..... 15/1.7; 210/169

[58] Field of Search ..... 15/1.7; 210/169

[56] References Cited

U.S. PATENT DOCUMENTS 3,384,914 5/1968 Wilhelmsen ..... 15/1.7

3,675,261 7/1972 Burgess ..... 15/1.7

*Primary Examiner*—Edward L. Roberts

*Attorney, Agent, or Firm*—Mark C. Jacobs

[57] ABSTRACT

A pool cleaner for brushing the sides of a pool and vacuuming the debris therein which attaches to the existing pool pump negating the need for an auxiliary pump. The device employs an expanding air chamber that expands and contracts to control the buoyancy of the device. The flow of water is drawn into the base, passes through a valve system and out through the return pipe to the pool.

6 Claims, 7 Drawing Figures

FIG. 5
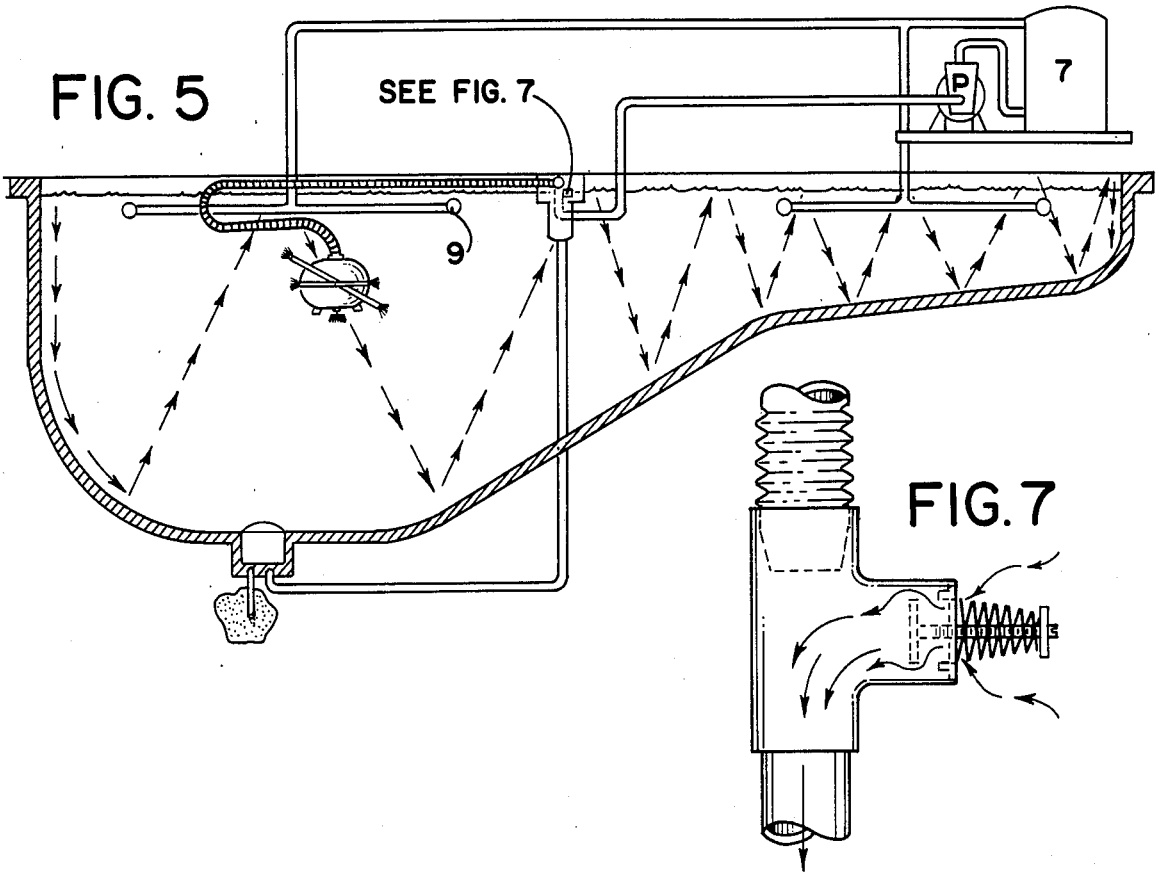
FIG. 7
FIG. 6
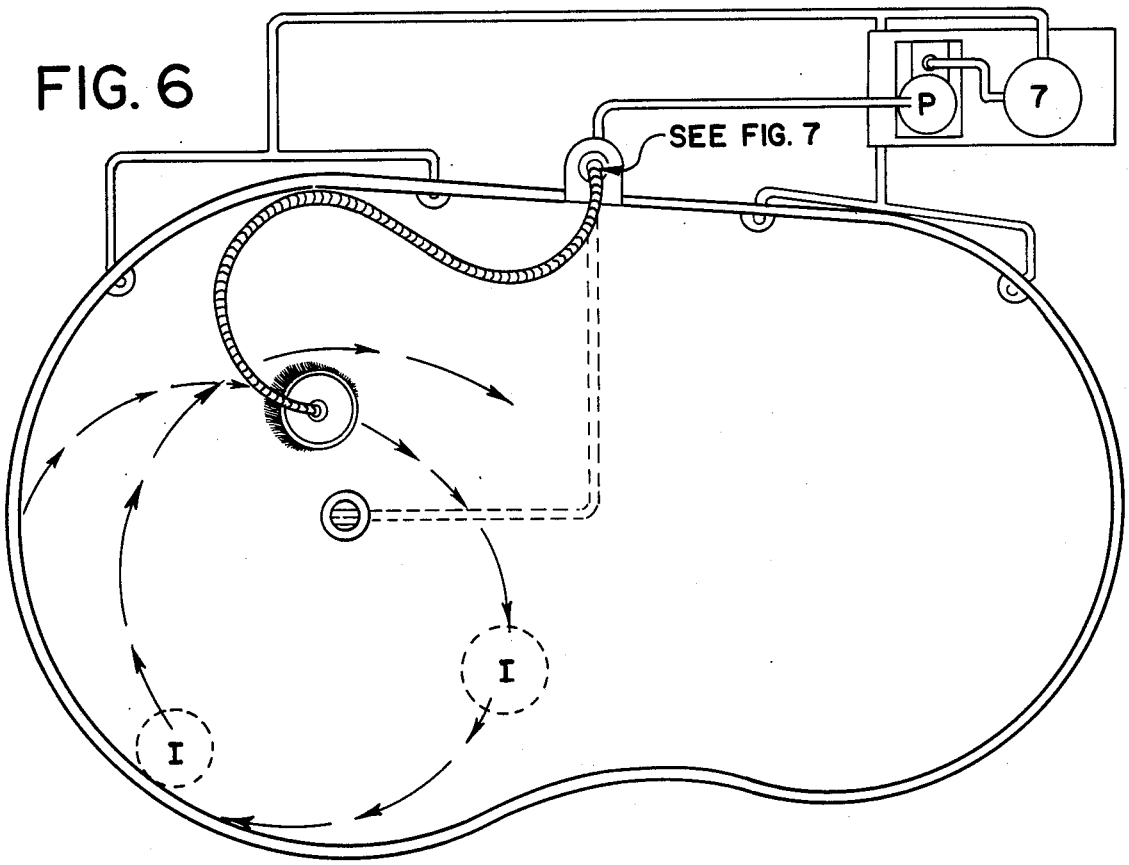

AUTOMATIC SWIMMING POOL CLEANER

SUMMARY OF THE INVENTION

At present the majority of pool cleaners have worked on the principle of high pressure water jets generated by means of an additional pump—the purpose of which is to lift and suspend impediments causing their eventual exit through the main drain. Since only loose matter is dislodged by this method, long lying algae bearing dirt is untouched and requires eventual scrubbing by hand by means of a long handled cumbersome brush from the pool edge.

A further problem of the prior art is that, even though they eventually clean the pool fluid, they often have no effect on the walls of the pool especially side walls. This pool cleaner, using its own substantial weight, is able to scour the walls and floor of the pool by means of brushes.

The pool cleaner, upon landing on the floor of the pool, activates a controlled closing of the main vacuum door which, once closed, allows the vacuum within the base of the vessel, to act upon a large rubber diaphragm which is pulled down into the evacuating water chamber and so enlarges the air chamber causing immediate buoyancy. The vessel rises to the surface by random direction; brushing all surfaces it comes in contact with.

The vessel, having reached the surface of the pool, can only descend by the opening of the main door. This is achieved by means of the vacuum working on a small orifice located beneath the valve piston and, aided by the weight suspended at the door, causes the door to open. The vessel then drops randomly, brushing as well as vacuuming all debris in its path.

At all times, while the door of the vessel remains closed, a vacuum controlled valve, inserted at the pool's skimmer, allows surface skimming to continue thereby preventing strain on the pool pump.

All debris captured by the vessel is directed to the pool's own filtration system. Since all swimming pools without exception, are equipped with a pump and filter to obtain water purification, this pool cleaner requires no additional energy using device to operate, but uses the pool's existing suction to perform its entire function.

DESCRIPTION OF THE DRAWINGS

FIG. 5 is a sectional elevational view of a typical swimming pool with its plumbing depicted in elevation; and with the device of this invention shown in elevation within said pool.

FIG. 6 is a top plan view of a typical swimming pool and its plumbing, and further showing the device of this invention in said pool.

FIG. 7 is an elevational view of a valve employed in this invention.

DESCRIPTION OF THE PREFERRED EMBODIMENT

Figure 1:
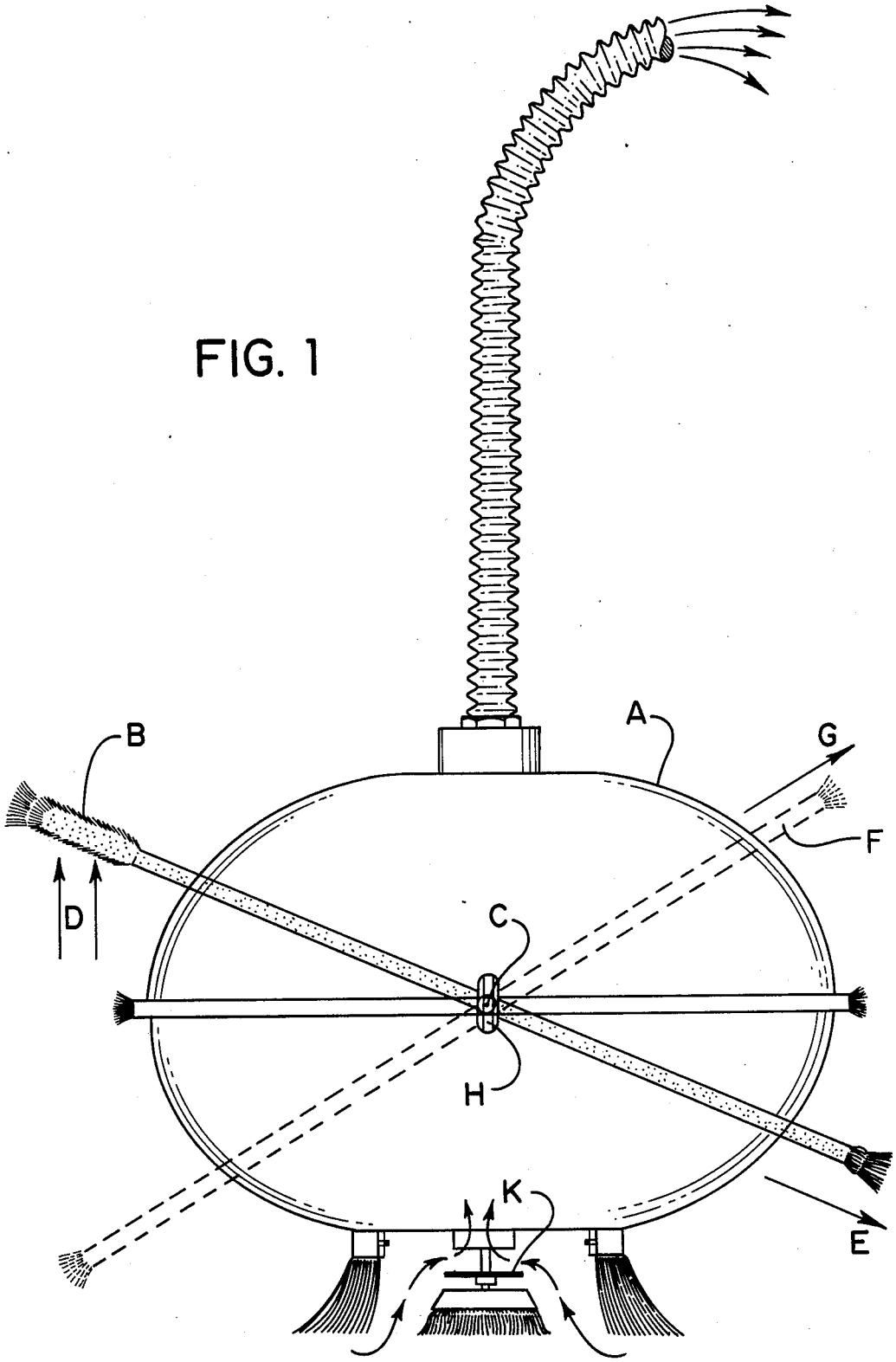
FIG. 1 is a vertical sectional view of the device of this invention, in a descending condition.

While the drawings have been described in the mode usually used for same, it is believed that for the sake of clarity, a further description of the parts depicted and the operation thereof, independent of the textual material that follows which explains the cooperation of the various elements and components is in order. In brief therefore it is seen that; FIG. 1 shows a side view of the variable buoyancy brush showing its rudder being forced to the top as it descend and its direction of travel shown by the lower right arrow. The bracket in the center of the vessel is designed to allow the raising or lowering of pivotal points to allow the vessel to ascend or descend in a turning motion as desired.

Figure 2:
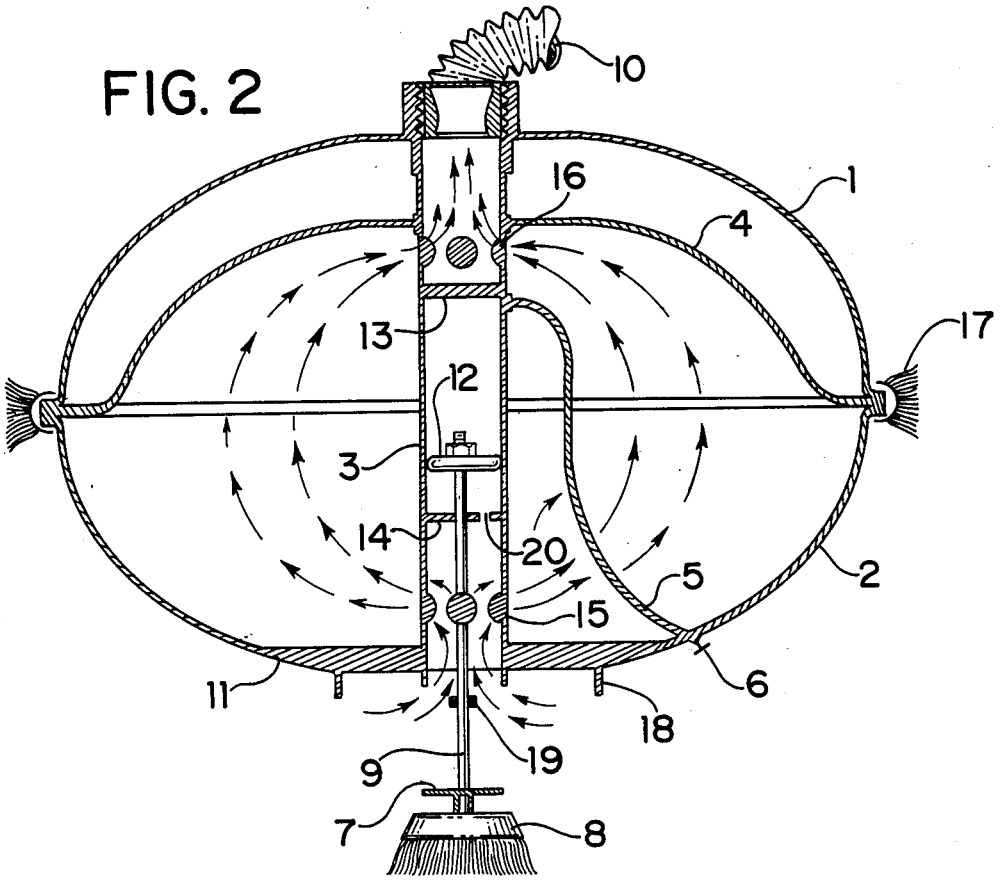
FIG. 2 is a side sectional view showing the device's expandable chamber in collapsed condition.

FIG. 2 shows the valve in the open position and vessel descending having an air chamber of insufficient volume to allow flotation of the vessel. FIG. 2 shows the complete inner working detail parts identified by Nos. 1–20 described as follows:

Items 1 and 2 are two separate stainless steel parts which, when joined, create a spherelike vessel.

Item 3 shows a center tube passing from top to bottom which houses the hydraulic valve.

Item 4 is a rubber diaphragm that attaches to the valve housing tube and the outer flanges of items 1 and 2 which seals the air chamber above.

Item 5 is a small plastic pipe which equalizes the water pressure from the valve chamber above the piston and the outside pool water, on a timed basis.

Item 6 shows the flow control valve that controls the flow of water to and from the valve chamber to which item 5 is attached.

Item 7 shows the main vacuum door. This door operates along the shaft in a designated space which, upon the vessel landing upon the floor of the pool, is drawn closer and closer to the door opening until sufficiently close enough to be snatched up the shaft by means of the vacuum and in-rushing water, thereby causing a rapid closure.

Item 8 is a weighted brush, the object of which is to aid in opening the door and to brush the floor of the pool upon landing.

Item 9 is a continuous shaft that originates at the valve piston and drops down to attach to brush (item 8).

Item 10 is the vacuum hose which is connected at the pool skimmer or pump vacuum, and is attached to the top of the vessel.

Item 11 shows weight placed in the vessel to ensure the sinking of the vessel when in FIG. 2 position and to cause the valve door to close.

Item 12 shows the valve piston sealed by "O" rings to the walls of the valve tube housing.

Item 13 shows upper partition for piston chamber.

Item 14 shows lower partition of piston chamber.

Item 15 and 16 are flow thru holes for water and the passage of debris on route to filter.

Item 17 shows brush attached to a clamp which serves to lock items 1 and 2 and seal item 4.

Item 18 is a bracket for brush attachments.

Item 19 shows stops attached to shaft located to restrict door movement along the shaft and to act as door opener when valve piston is descending.

Item 20 shows orifice in lower piston chamber seal to allow timed evacuation of water from piston chamber and to allow vacuum in door closed position, to assist in piston descent.

Figure 3:
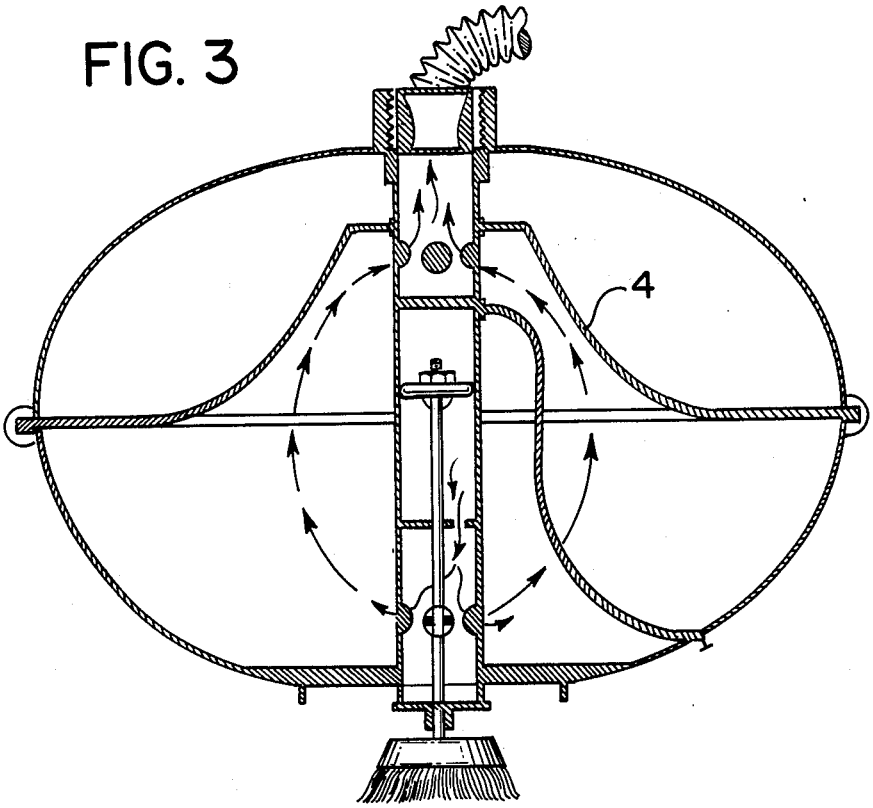
FIG. 3 is a view similar to FIG. 2 showing the expandable chamber in expanded condition.

FIG. 3 shows the valve position closed and rubber diaphragm in lower position with air chamber enlarged above—vessel in buoyant position.

Figure 4:
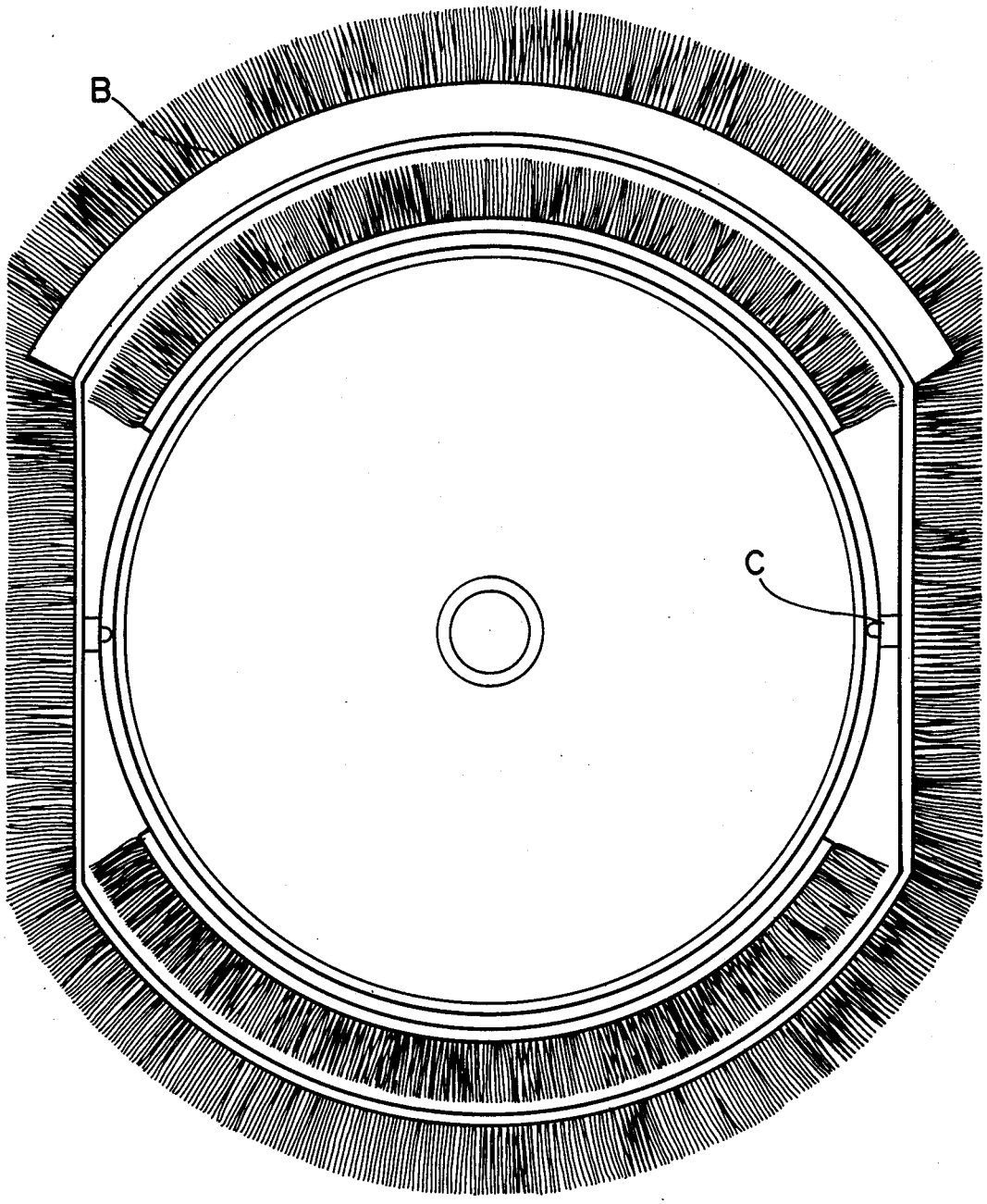
FIG. 4 is a top plan view of the brush portion of this invention.

FIG. 4 shows the brush attachments to the vessel as seen from above. Enlarged darkened area is the rudder with brush attached located on one side of the vessel only and attached to the center of the vessel, thus allowing a hinged like motion which causes the vessel to move sideways as it ascends and descends.

FIG. 5 shows a typical swimming pool with pump, filter and standard pipework, showing the pool cleaner attached to the skimmer by means of a hose. The arrows indicate its path as it descends and ascends, brushing all surfaces, walls and floor it comes into contact with and vacuuming while descending and stationary on pool floor before door closure occurs.

FIG. 6 shows curving direction of descent and ascent achieved by adjustment of pivotal points of outer rudder as shown in FIG. 1.

FIG. 7 shows a typical vacuum breaker spring loaded valve. The valve operates below pool water level and when subjected to an increase in vacuum, allows water to flow into the system to ensure the reduction of strain on the pump impaler. The spring can be adjusted by means of a threaded screw and nut and is located in the base of the skimmer in the suction line to pump. See FIG. 6.

While the invention will be described with reference to swimming pools, it will be realized that the concepts described herein are equally applicable to other confined fluid bodies such as pool type nuclear reactors, water storage tanks, percolation ponds and the like. With regard to all of these devices the main object is to achieve rapid and thorough cleaning of the fluid body.

With reference to FIG. 1, the cleaning vessel 100 is shown in a descending mode with the bottom door 7 in the open position; the pool pump is sucking the debris and water up through the bottom of the vessel, into the attached hose and conveying it to the filter where the water is filtered, cleaned, and returned to the pool through pipes as shown in FIG. 5*j*. Note that in the descending mode the rudder brush 17 is forced upward by the water currents 30 as the vessel sinks. Because of the large surface of this rudder brush, and its further distance from the fulcrum points 31, it causes the vessel to be steered in the direction of the arrow 33.

The dotted lines marked 35 show the position of the rudder brush when the vessel is ascending, and the arrow marked 34 shows its sideways motion. By raising or lowering the fulcrum points 31 on either side in the sliding slot brackets 32, the direction of movements (34 and 33) become curved thus allowing the user to adjust the direction of movement according to the size and shape of the pool. As shown in FIG. 6 (1), the opposite curving motion can be achieved by reversing the high and low positions of the fulcrum points 31.

The ascending and descending motion of the vessel is regulated by the inner valve mechanism FIGS. 2 and 3 allowing the vessel to achieve full travel to the surface of the pool and reversely, to the floor. The additional sideways and curving motions described above, allow complete coverage of the pool walls and floor at random direction.

The rubber diaphragm FIGS. 2 and 3 (4) located horizontally inside the vessel and is attached at its center to the valve, just above the top portholes to prevent any water from entering the closed air chamber, separated by the diaphragm from the water chamber. The outer edge of the diaphragm is sealed to the outer edge of the vessel and leakage of water into the air chamber is further prevented by means of an "O" ring molded into its shape which is pinched between the upper and lower halves of the vessel FIG. 2 (1 and 2) tightly held there by means of a ring shaped metal clamp that surrounds the vessel 17 ' FIG. 2 (17') to which is attached brush bristles.

The function of the diaphragm is first to maintain a completely sealed air chamber, the second is to enlarge the air chamber when a vacuum condition occurs within the water chamber which is brought about by the action of the bottom door FIG. 1 (K) closing upon the vessel's arrival at the pool floor thereby the air above is expanded and the body of water inside the vessel is diminished. This displacement of water allows the vessel to achieve flotation and rise to the surface.

FIGS. 2 and 3 show a cylindrical shaped valve which is affixed vertically to the interior of the vessel beginning at the vacuum hose connection, and consists of a pipe with an opening at each end. A separate piston chamber is located in the middle of said pipe, above and below the chamber are portholes FIG. 2 (15 and 16) that allow the passage of water to bypass the piston chamber as it passes through the vessel.

Attached to the piston and continuing through the vessel, is a shaft FIG. 2 (9) which terminates outside the vessel at its base and to which is attached a weighted brush 8 per FIG. 2.

Above the brush is located a door 7 per FIG. 2 which moves up and down the shaft within a designated distance. Located midway on the shaft is a stop (19) that forces against the closed door as the shaft and piston descend causing it to open and drop away from the bottom of the vessel with the additional pull of the weighted brush.

This action causes the relaxing of the vacuum within the vessel and water and debris are allowed to be drawn through the vessel from the pool. The diaphragm is then allowed to return to its higher position and the cycle begins again.

The velocity and weight of the vessel further aids in the brushing of the walls and floor. The approximate weight of the vessel when empty is 12 lbs, however when submerged and in the descending mode, the vessel weights an additional 20 lbs or more due to the body of water passing through the vessel. (Obviously, larger or smaller vessels can be built with varying proportions.)

The vessel in the ascending mode FIG. 3, with the door closed, weighs considerably less due to he evacuation of water from within the vessel and the large air chamber that is achieved by the downward movement of the diaphragm as shown in FIG. 3 element (4). It should be noted that not all of the water within the body of the vessel is evacuated, only the amount required to achieve flotation which is controlled by the timed closing and opening of the door as shown in FIG. 2 (7).

The door, 7 is free to slide up and down the shaft 9 between the stop 19 and the base basket 8, the description of which is set forth below. The purpose of the movement along this shaft is to permit the door to be sucked up the shaft at a point in time when the door, 7, is close enough to the opening for the vacuum associated with the in rushing water to shove the door up the shaft and thereby close off the opening.

The reader's attention is called to the fact, as shown clearly in FIG. 3 that the movement of piston 12 is tied to the movement of the door, 7. The piston 12, can only move up or down in the piston chamber if the water in the chamber above or below the piston itself is evacuated or returned. The velocity of the piston's travel is governed by the flow control valve, 6 disposed at the end of tube 5, since said valve governs the ability of the piston chamber to be evacuated as is seen in FIG. 3.

As described above, the movement of the vessel enables it to clean all areas of the pool by means of both brushing and vacuuming—hesitating at the floor area to ensure removal of all debris from beneath its brushes, and pausing briefly at the surface to ensure maximum travel.

The movement through the water of such a large vessel causes a stirring of the water body, which in turn, aids in the suspension of particles and impediments in the immediate area of the vacuum inlet at the base of the vessel, thus enabling prompt and efficient removal of same. Such movement of water also helps prevent the adhesion of algae growth, and the existence of dead spots where there is little or no circulation of water. The majority of pool cleaners on the market at the present time rely upon the suspension and settlement of impediments until they are eventually removed by the main drain. This vessel removes the particles and impediments in the immediate area as it suspends them—in effect, the vessel becomes a main drain in motion.

Because vacuums attached to pools are not of the same intensity, it is preferred that a valve as shown in FIG. 7, be placed inside the pool skimmer to adjust the maximum effectiveness of the vessel and to allow surface skimming to occur at the surface of the pool. This valve will also reduce strain upon the pool pump.

While the operation of the instant device has been recited above, in order to clarify certain aspects further, certain things bear repeating. Thus it is seen that in order to move the piston 12, within the chamber, two forces come into play. First, the weight of the vessel when filled with water, ie the flooded condition, and sinking toward the bottom whereby on impact there is a force bearing upon the brush as the said brush arrives at the pool bottom. When this transpires, the distance between the door 7, and the door opening is maximized such that the vacuum is unable to suck it closed thus allowing the cleaning of the area beneath the vessel to take place.

The second force previously mentioned, now comes into play. It is seen that as the water is vacuumed out of the vessel immediately after the closing of the door, causing the air volume to expand, thus causing the vessel to rise. Now, referring to FIG. 3, it is seen that tiny orifice 20, beneath the piston allows the water to be removed from beneath the piston by the vacuum slowly moving the piston 20, and the the shaft 9 downwardly till the the stop 19 which is moving along the shaft simultaneously, reaches and impacts the closed door, 7. At this point the vacuum present, pulls both the piston and the door equally. Opening of the door is now achieved by the weight of the base brush 8, acting as a mechanical advantage. Voila, the door opens, the vessel is flooded, and descends to begin the cycle again.

What is claimed is:

1. An apparatus for cleaning debris from a swimming pool which comprises:

(a) a variable buoyancy vessel adapted to hold changeable masses of air and water;

(b) a centrally disposed vertical tube having a lower port and an upper port, the upper port being adapted for connection to a vacuum hose from the swimming pool, and the lower port communicating to the pool water;

(c) a piston chamber disposed within said tube;

(d) a piston rod extending downwardly from with the said piston chamber to outside the chamber, and having;

(e) a piston mounted at one end of said rod within said piston chamber and a brush at the opposite end of said piston rod, disposed external of said vessel;

(f) door means for closing off said tube disposed intermediate said brush and said piston on said shaft, and external to said vessel;

(g) an adjustable diaphragm within said vessel adapted to segregate said vessel into an air containing first section and a water containing second section;

(h) means, which includes said piston chamber, piston and door, for both enlarging the air mass within the air section while reducing the water mass to give the apparatus buoyancy and motion; and means, which includes said piston chamber, piston and door, for reducing the air mass and enlarging the water mass to permit ingress of pool water and debris through the vessel and out the upper port, wherein the inherent weight of the vessel upon its impact on the bottom of the pool bears down upon the door means to thereby commence closing of the door means; subsequent to which door means closing the said vessel's mass of air changes increasingly and the mass of water changes decreasingly and the said piston descends until such time as it impacts the door means causing the door means to open and water to flood in, thereby again changing the mass of both air and water in the vessel causing the vessel to sink until the door means hits bottom again.

2. The device of claim 1 further including means for equalizing the water pressure from the piston chamber above the piston with the outside pool water on a timed basis.

3. The device of claim 1 wherein said tube has at least one bore above and at least one bore below said piston chamber which bores communicate with said water section of said vessel.

4. The device of claim 1 further including brush means disposed on the side of said vessel.

5. The apparatus of claim 1 further including a hoop shaped rudder brush means surrounding said vessel and pivotally mounted thereto on two opposed axially aligned fulcrums, the pivotal mounting including means for elevating the fulcrum points, said hoop shaped brush adapted to cause changes of direction of the vessel whilst in motion.

6. An apparatus for cleaning debris from a swimming pool which comprises:

(a) a variable buoyancy vessel adapted to hold changeable masses of air and water;

(b) a centrally disposed vertical tube having a lower port and an upper port, the upper port being adapted for connection to a vacuum hose from the swimming pool, and the lower port communicating to the pool water;

(c) a piston chamber disposed within said tube;

(d) a piston rod extending downwardly from with the said piston chamber to outside the chamber, and having;

(e) a piston mounted at one end of said rod within said piston chamber and an abrasive means at the opposite end of said piston rod, disposed external of said vessel;

(f) door means for closing off said tube disposed intermediate said abrasive means and said piston on said shaft, and external to said vessel;

(g) an adjustable diaphragm within said vessel adapted to segregate said vessel into an air containing first section and a water containing second section;

(h) means, including said piston chamber, piston and door, for both enlarging the air mass within the air section while reducing the water mass to give the apparatus buoyancy and motion; and means, including said piston chamber, piston and door, for reducing the air mass and enlarging the water mass to permit ingress of pool water and debris through the vessel and out the upper port, (i) means for equalizing the water pressure from the valve chamber above the piston with the ouside pool water on a times basis, and wherein said tube has at least one bore above and at least one bore below said piston chamber which bores communicate with said water section of said vessel, wherein the inherent weight of the vessel upon its impact on the bottom of the pool bears down upon the door means to thereby commence closing of the door means; subsequent to which door means closing the said vessel's mass of air changes increasingly and the mass of water changes decreasingly and the said piston descends until such time as it impacts the door means causing the door means to open and water to flood in, thereby again changing the mass of both air and water in the vessel causing the vessel to sink until the door means hits bottom again.

* * * * *